US010507676B2

(12) United States Patent
Yuasa

(10) Patent No.: US 10,507,676 B2
(45) Date of Patent: Dec. 17, 2019

(54) INKJET RECORDING APPARATUS INCLUDING ROTATABLE HEAD BASE AND ROTATABLE CONVEYANCE UNIT

(71) Applicant: KYOCERA Document Solutions Inc., Osaka (JP)

(72) Inventor: Yuzuru Yuasa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/029,729

(22) Filed: Jul. 9, 2018

(65) Prior Publication Data

US 2019/0016156 A1 Jan. 17, 2019

(30) Foreign Application Priority Data

Jul. 12, 2017 (JP) ..... 2017-136234

(51) Int. Cl.
*B41J 11/00* (2006.01)

(52) U.S. Cl.
CPC ..... *B41J 11/007* (2013.01)

(58) Field of Classification Search
CPC ..... B41J 11/007; B41J 2/2146; B41J 25/003
See application file for complete search history.

(56) References Cited

U.S. PATENT DOCUMENTS

2004/0250760 A1* 12/2004 Goto ..... B41J 2/145 118/300
2006/0238565 A1* 10/2006 Jung ..... B41J 2/2139 347/37
2010/0149248 A1* 6/2010 Enomoto ..... B41J 3/543 347/19
2010/0150632 A1* 6/2010 Matsumoto ..... B41J 2/515 399/395

FOREIGN PATENT DOCUMENTS

JP 2010-094841 A 4/2010

* cited by examiner

*Primary Examiner* — Bradley W Thies
(74) *Attorney, Agent, or Firm* — Studebaker & Brackett PC

(57) ABSTRACT

An inkjet recording apparatus includes an inkjet head, a head base, a conveyance unit, and a rotation mechanism. The inkjet head ejects ink on to a sheet. The inkjet head is fixed to the head base. The conveyance unit faces the inkjet head and conveys the sheet. The rotation mechanism rotates the head base and the conveyance unit around an axis perpendicular to a sheet conveyance surface of the conveyance unit while maintaining a constant relative position of the head base to the conveyance unit.

11 Claims, 12 Drawing Sheets

INKJET RECORDING APPARATUS INCLUDING ROTATABLE HEAD BASE AND ROTATABLE CONVEYANCE UNIT

INCORPORATION BY REFERENCE

The present application claims priority under 35 U.S.C. § 119 to Japanese Patent Application No. 2017-136234, filed on Jul. 12, 2017. The contents of this application are incorporated herein by reference in their entirety.

BACKGROUND

The present disclosure relates to an inkjet recording apparatus.

A linehead printer includes a first head, a second head, a conveyance unit, a first position adjustor, and a second position adjustor. The first head and the second head eject ink on to a sheet to form an image on the sheet. The conveyance unit conveys the sheet. The first position adjustor adjusts a position of the heads in a sheet width direction. The second position adjustor adjusts a position of the heads in an intersecting direction. The intersecting direction means a direction diagonally intersecting the sheet width direction.

The first position adjustor and the second position adjustor inhibit a streaked image from being formed on the sheet by adjusting relative positions of the first head and the second head. The streaked image includes white and black streaks in a sheet conveyance direction.

SUMMARY

An inkjet recording apparatus according to an aspect of the present disclosure includes an inkjet head, a head base, a conveyance unit, and a rotation mechanism. The inkjet head ejects ink on to a sheet. The inkjet head is fixed to the head base. The conveyance unit faces the inkjet head and conveys the sheet. The rotation mechanism rotates the head base and the conveyance unit around an axis perpendicular to a sheet conveyance surface of the conveyance unit while maintaining a constant relative position of the head base to the conveyance unit.

DETAILED DESCRIPTION

Figure 1:
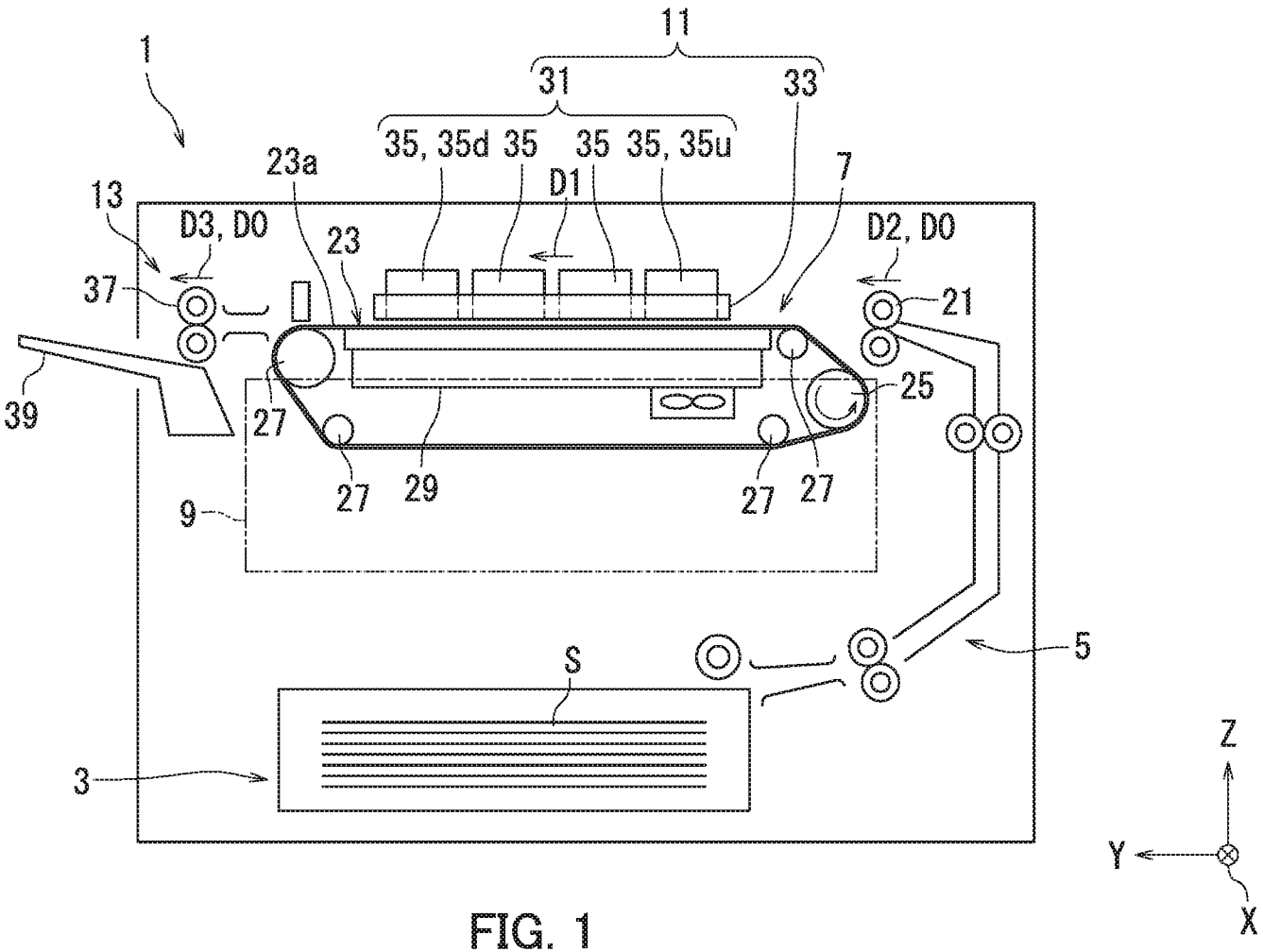
FIG. 1 is a schematic cross-sectional view illustrating an inkjet recording apparatus according to an embodiment of the present disclosure.

An embodiment of the present disclosure will be described as follows while referring to the drawings. Note that elements within the drawings that are the same or equivalent will be referred to with the same reference numbers and description thereof will not be repeated. In a three-dimensional rectangular coordinate system according to the embodiment, an X-axis and a Y-axis are parallel to a horizontal direction and a Z-axis is parallel to a vertical direction.

First, an inkjet recording apparatus 1 according to the embodiment of the present disclosure will be described with reference to FIG. 1. FIG. 1 is a schematic cross-sectional view illustrating the inkjet recording apparatus 1. As illustrated in FIG. 1, the inkjet recording apparatus 1 includes a feeding section 3, a conveyance section 5, a conveyance unit 7, a lifting section 9, an image forming unit 11, and an ejection section 13. The conveyance section 5 includes a registration roller 21. The conveyance unit 7 includes an endless conveyor belt 23, a drive roller 25, a plurality of tension rollers 27, and a suction section 29. The image forming unit 11 includes an inkjet head 31 and a head base 33. The ejection section 13 includes an ejection roller 37 and an exit tray 39. According to the present embodiment, the inkjet recording apparatus 1 is a line head type inkjet printer.

The feeding section 3 houses a plurality of sheets S and feeds the sheets S a sheet at a time toward the conveyance section 5. Examples of a sheet S include plain paper, thin paper, thick paper, and coated paper.

The conveyance section 5 conveys the sheet S fed from the feeding section 3 toward the conveyance unit 7. Specifically, the registration roller 21 of the conveyance section 5 performs skew correction for the sheet S stopped by making contact with the registration roller 21. Then, the registration roller 21 sends the sheet S toward a sheet conveyance surface 23*a* of the conveyance unit 7 at a timing of image formation by the inkjet head 31. The sheet conveyance surface 23*a* is a surface on which the sheet S is placed. The registration roller 21 is located farther upstream than the conveyance unit 7 in a first sheet conveyance direction D1 (sheet conveyance direction). The first sheet conveyance direction D1 means a conveyance direction of the sheet S by the conveyance unit 7.

The conveyance unit 7 conveys the sheet S sent from the registration roller 21. The conveyance unit 7 faces the inkjet head 31. Specifically, the conveyance unit 7 conveys the sheet S toward a position beneath the inkjet head 31. Thereafter, the conveyance unit 7 conveys the sheet S with an image formed thereon by the inkjet head 31 toward the ejection roller 37.

More specifically, the conveyor belt 23 of the conveyance unit 7 is stretched by the drive roller 25 and the tension rollers 27. The rotation of the drive roller 25 rotates the conveyor belt 23. The conveyor belt 23 has the sheet conveyance surface 23*a*. The sheet conveyance surface 23*a* faces the inkjet head 31. The first sheet conveyance direction D1 indicates an advancing direction of the sheet conveyance surface 23*a*. That is, the first sheet conveyance direction D1 indicates a direction of conveyance force by the sheet conveyance surface 23*a*. The suction section 29 draws the sheet S to the sheet conveyance surface 23*a* through a plurality of suction holes (not illustrated) in the conveyor belt 23. As a result, the sheet S is tightly held to the sheet conveyance surface 23*a* and conveyed.

The lifting section 9 raises or lowers the conveyance unit 7 in a direction substantially orthogonal to the sheet conveyance surface 23*a*, between an image formation position and a retraction position. The conveyance unit 7 is raised to be in the image formation position. An image is formed on the sheet S while the conveyance unit 7 is in the image formation position. By contrast, the conveyance unit 7 is lowered to be in the retraction position. According to the present embodiment, when the distance between the inkjet head 31 and the sheet conveyance surface 23*a* is altered, or rather when the image formation position is altered, the lifting section 9 lowers the conveyance unit 7 from a pre-alteration image formation position to the retraction position. The lifting section 9 then raises the conveyance unit 7 from the retraction position to a post-alteration image formation position.

The image forming unit 11 forms the image on the sheet S. Specifically, the inkjet head 31 of the image forming unit 11 ejects ink on to the sheet S on the sheet conveyance surface 23*a* to form the image on the sheet S. The inkjet head 31 is fixed to the head base 33.

More specifically, the inkjet head 31 includes a plurality of head units 35 (four head units 35 according to the present embodiment). Each head unit 35 ejects an ink of a different color. The head units 35 are arranged in the first sheet conveyance direction D1. The head units 35 are fixed to the head base 33.

In the following, the head unit 35 located furthest upstream among the head units 35 in the first sheet conveyance direction D1 may be referred to as a "head unit 35*u*". The head unit 35 located furthest downstream among the head units 35 in the first sheet conveyance direction D1 may be referred to as a "head unit 35*d*".

The ejection section 13 ejects the sheet S with the image formed thereon. Specifically, the ejection roller 37 of the ejection section 13 ejects the sheet S conveyed by the conveyance unit 7 to the exit tray 39. The ejection roller 37 is located farther downstream in the first sheet conveyance direction D1 than the conveyance unit 7.

Figure 2:
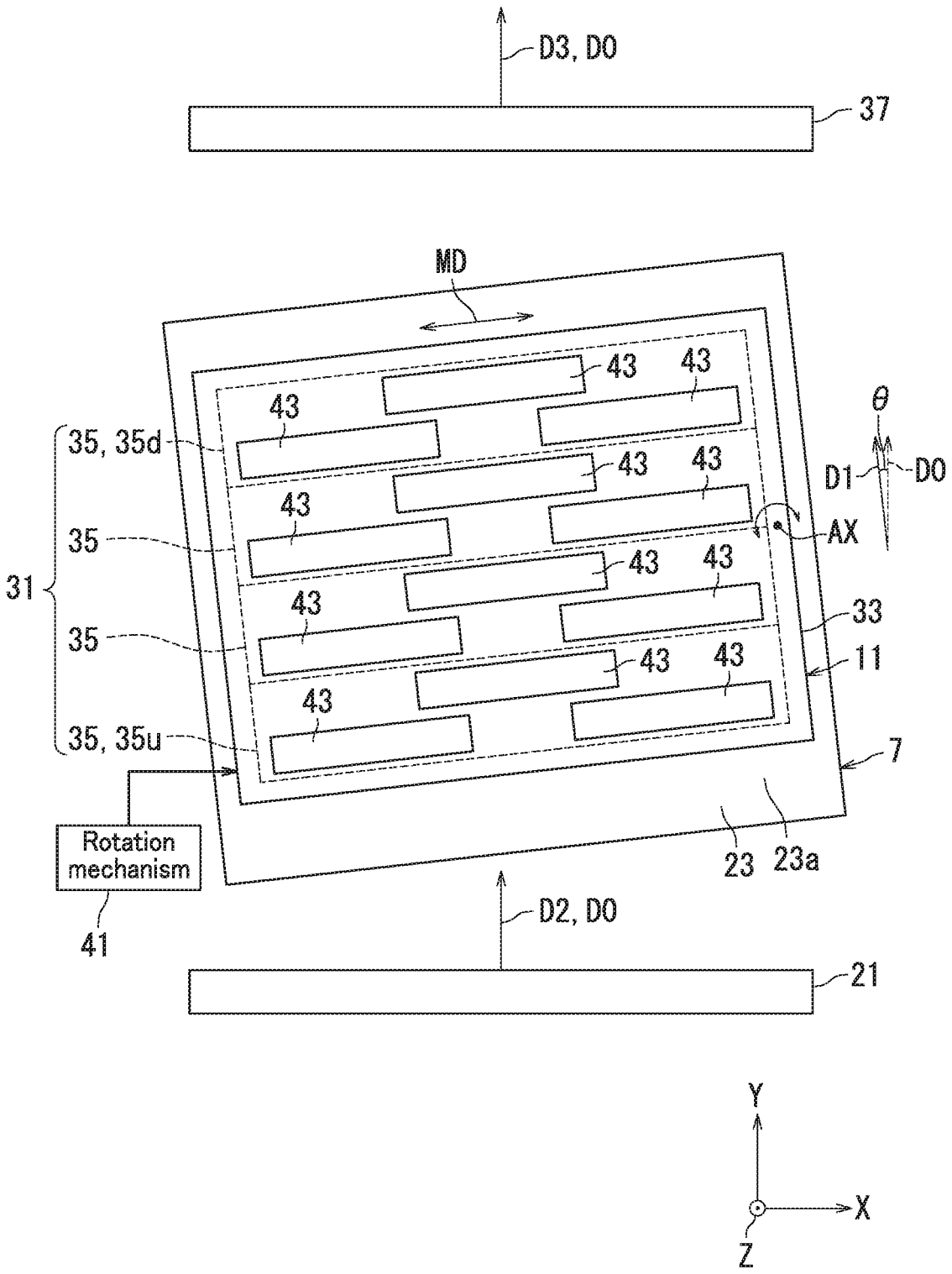
FIG. 2 is a schematic plan view illustrating a conveyance unit and an image forming unit before rotation according to the embodiment.

Next, a mechanism for rotating the conveyance unit 7 and the image forming unit 11 will be described with reference to FIG. 2. FIG. 2 is a plan view illustrating the conveyance unit 7 and the image forming unit 11.

As illustrated in FIG. 2, the inkjet recording apparatus 1 further includes a rotation mechanism 41. The rotation mechanism 41 integrally rotates the conveyance unit 7 and the head base 33 around an axis AX. In other words, the rotation mechanism 41 integrally rotates the conveyance unit 7 and the image forming unit 11 around the axis AX because the inkjet head 31 is fixed to the head base 33. The axis AX is substantially perpendicular to the sheet conveyance surface 23*a* of the conveyance unit 7. Specifically, the rotation mechanism 41 rotates the head base 33 and the conveyance unit 7 around the axis AX while maintaining a constant relative position of the head base 33 to the conveyance unit 7.

According to the present embodiment, the integral rotation of the conveyance unit 7 and the head base 33 is the same as the integral rotation of the conveyance unit 7 and the image forming unit 11.

According to the present embodiment as described above with reference to FIG. 2, the rotation mechanism 41 can adjust the first sheet conveyance direction D1 of the conveyance unit 7 by integrally rotating the conveyance unit 7 and the head base 33. Accordingly, the rotation mechanism 41 can align the first sheet conveyance direction D1 with at least one of the following: a second sheet conveyance direction D2 of the registration roller 21 and a third sheet conveyance direction D3 of the ejection roller 37. As a result, it is possible to reduce influence of the conveyance force of at least one of the registration roller 21 and the ejection roller 37 to be received by the sheet S on the sheet conveyance surface 23*a*.

The second sheet conveyance direction D2 means a direction of conveyance of the sheet S by the registration roller 21. That is, the second sheet conveyance direction D2 means a direction of the conveyance force from the registration roller 21, orthogonal to a rotary shaft of the registration roller 21. The third sheet conveyance direction D3 means a direction of conveyance of the sheet S by the ejection roller 37. That is, the third sheet conveyance direction D3 means a direction of the conveyance force from the ejection roller 37, orthogonal to a rotary shaft of the ejection roller 37.

Because the influence of the conveyance force of at least one of the registration roller 21 and the ejection roller 37 can be reduced, the advancing direction of the sheet S can be prevented from changing while the inkjet head 31 is in the midst of forming an image on the sheet S. As a result, formation of a streaked image on the sheet S can be prevented. That is, the quality of the image formed on the sheet S can be prevented from decreasing. For example, the quality of the image can be prevented from decreasing even when an image is formed on a sheet S that is long in a sub-scanning direction of the inkjet head 31.

Next, a method for adjusting the first sheet conveyance direction D1 by the rotation mechanism 41 will be described with additional reference to FIG. 2. For example, the rotation mechanism 41 can bring the first sheet conveyance direction D1 closer to the second sheet conveyance direction D2 or align the first sheet conveyance direction D1 with the second sheet conveyance direction D2. For another example, the rotation mechanism 41 can bring the first sheet conveyance direction D1 closer to the third sheet conveyance direction D3 or align the first sheet conveyance direction D1 with the third sheet conveyance direction D3. For another example, the rotation mechanism 41 can bring the first sheet conveyance direction D1 closer to a direction between the second sheet conveyance direction D2 and the third sheet conveyance direction D3 or align the first sheet conveyance direction D1 with the direction between the second sheet conveyance direction D2 and the third sheet conveyance direction D3.

However, the adjustment method of the first sheet conveyance direction D1 is not particularly limited as long as the rotation mechanism 41 integrally rotates the conveyance unit 7 and the head base 33.

For example, the rotation mechanism 41 integrally rotates the conveyance unit 7 and the head base 33 such that the advancing direction of the sheet S has less or no deviation relative to a prescribed conveyance direction. Deviation in the advancing direction of the sheet S can be detected in a manner described as follows, for example. That is, the inkjet head 31 forms a specific image on the sheet S. A worker then detects the deviation in the advancing direction of the sheet S by visually examining the specific image.

Figure 3:
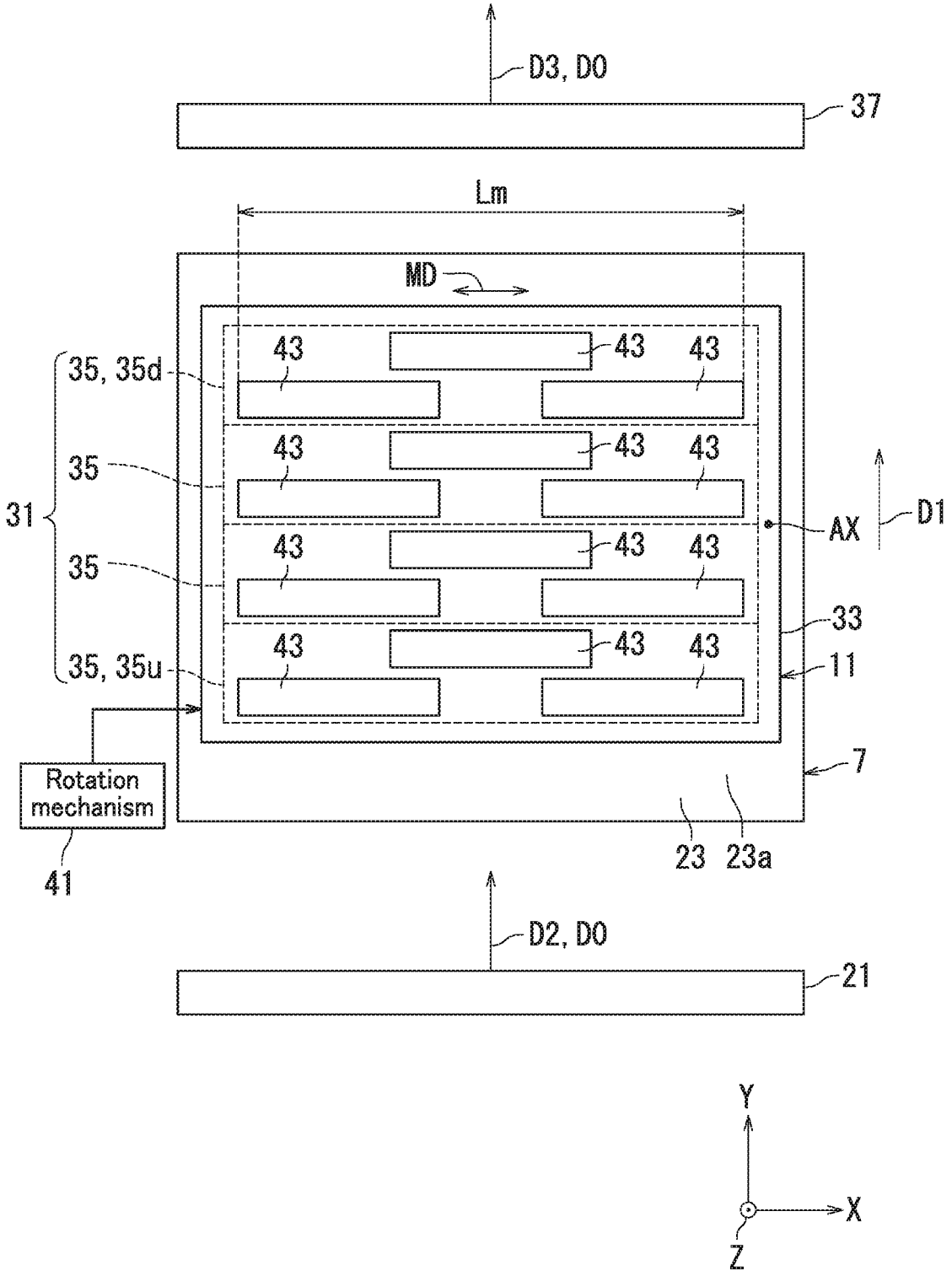
FIG. 3 is a schematic plan view illustrating the conveyance unit and the image forming unit after rotation according to the embodiment.

Next, an example of the adjustment method of the first sheet conveyance direction D1 by the rotation mechanism 41 will be described with reference to FIGS. 2 and 3. FIG. 2 illustrates the conveyance unit 7 and the image forming unit 11 before rotation. FIG. 3 illustrates the conveyance unit 7 and the image forming unit 11 after rotation.

In FIGS. 2 and 3, the second sheet conveyance direction D2 and the third sheet conveyance direction D3 are the same for ease of understanding. Accordingly, the second sheet conveyance direction D2 and the third sheet conveyance direction D3 will be collectively referred to as a "specific conveyance direction D0".

As illustrated in FIG. 2, the rotation mechanism 41 can integrally rotate the conveyance unit 7 and the head base 33 around the axis AX clockwise as well as counterclockwise.

In FIG. 2, the first sheet conveyance direction D1 is tilted counterclockwise at an angle θ relative to the specific conveyance direction D0. Therefore, as illustrated in FIGS. 2 and 3, the rotation mechanism 41 integrally rotates the conveyance unit 7 and the head base 33 clockwise around the axis AX by the angle θ. Accordingly, as illustrated in FIG. 3, the first sheet conveyance direction D1 aligns with the specific conveyance direction D0. As a result, it is possible to reduce influence of the conveyance force from the registration roller 21 and the ejection roller 37 to be received by the sheet S on the sheet conveyance surface 23*a*.

Note that as illustrated in FIG. 3, each head unit 35 includes pluralities of recording heads 43 (three recording heads 43 according to the present embodiment). In each head unit 35, the recording heads 43 are arranged staggered in a main scanning direction MD of the inkjet head 31. The main scanning direction MD is orthogonal to the first sheet conveyance direction D1 and parallel to the sheet conveyance surface 23*a*. The main scanning direction MD is orthogonal to the sub-scanning direction. Each head unit 35 has a maximum ink ejection range Lm. The maximum ink ejection range Lm indicates a maximum value of an ink ejection range of a head unit 35 in the main scanning direction MD. That is, the maximum ink ejection range Lm indicates a distance from a nozzle on one end of the head unit 35 in the main scanning direction MD to a nozzle on the other end of the head unit 35 in the main scanning direction MD, among a large number of nozzles included in the head unit 35.

Figure 4:
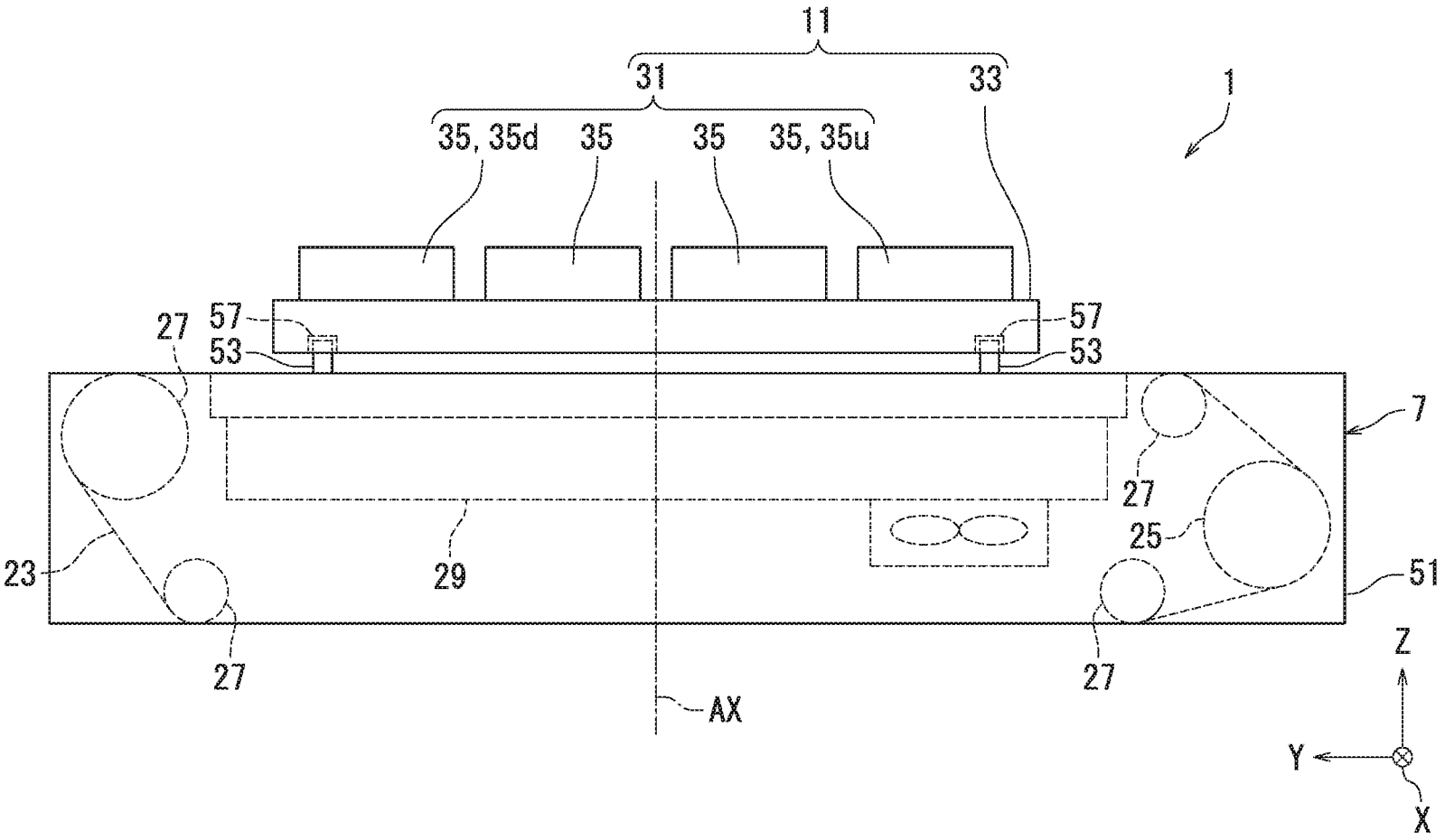
FIG. 4 is a schematic side view illustrating the conveyance unit and the image forming unit according to the embodiment.

Next, a configuration for integrally rotating the conveyance unit 7 and the head base 33 will be described with reference to FIG. 4. FIG. 4 is a schematic side view illustrating the conveyance unit 7 and the image forming unit 11. As illustrated in FIG. 4, the conveyance unit 7 further includes a conveyance frame 51 and a plurality of fitting members 53. The conveyance frame 51 rotatably supports the drive roller 25 and the tension rollers 27.

Each fitting member 53 protrudes from the conveyance frame 51 toward the head base 33. By contrast, the head base 33 has a plurality of fitting holes 57 corresponding to the fitting members 53. The fitting members 53 respectively fit the fitting holes 57. Accordingly, the head base 33 and the conveyance unit 7 are bound together. As a result, the conveyance unit 7 and the head base 33 integrally rotate around the axis AX. That is, as the head base 33 rotates around the axis AX, the conveyance unit 7 rotates around the axis AX together with the head base 33.

Each fitting member 53 and each fitting hole 57 extends in a direction substantially orthogonal to the sheet conveyance surface 23*a*. Accordingly, the lifting section 9 (FIG. 1) can easily raise and lower the conveyance unit 7.

Figure 5:
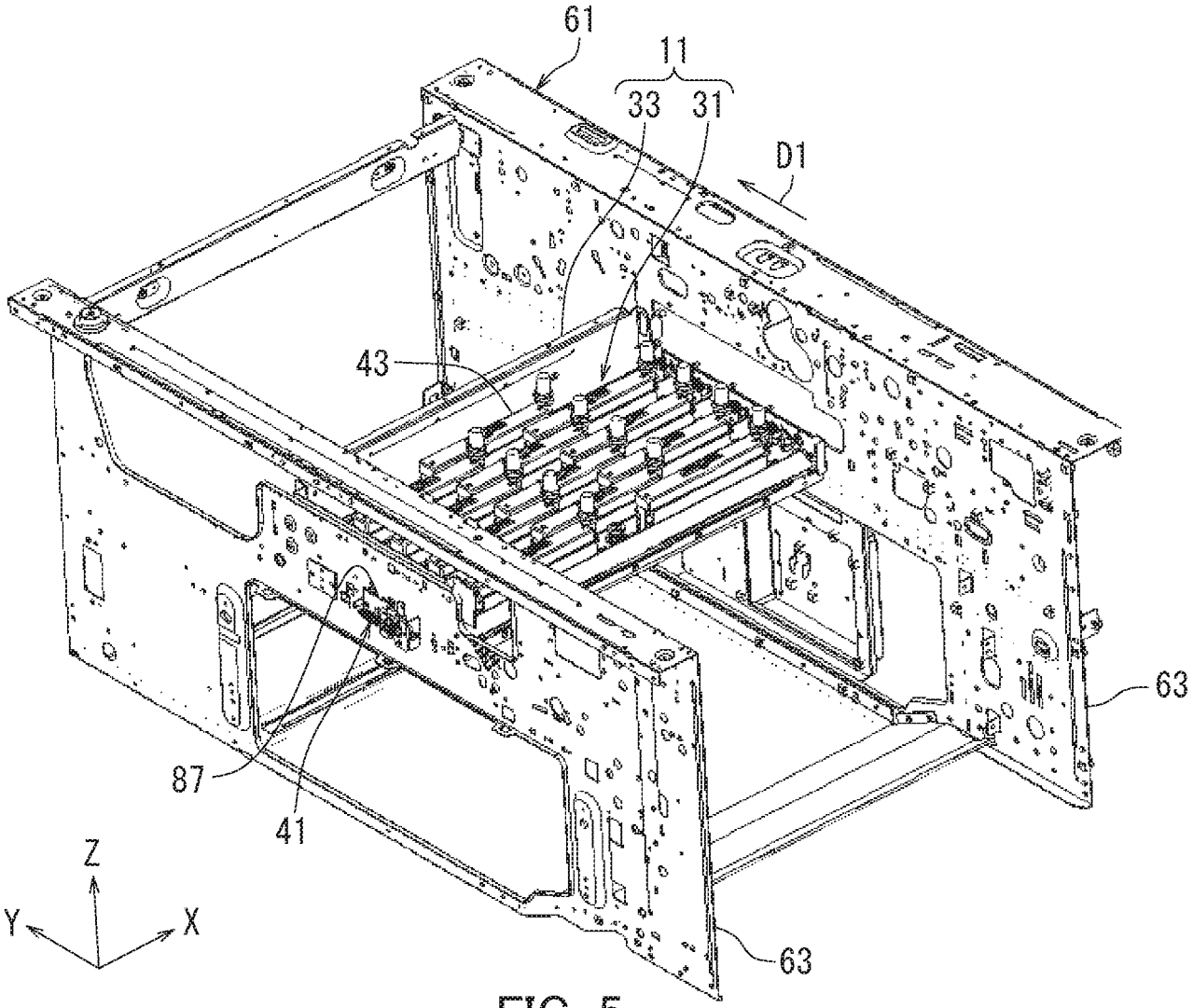
FIG. 5 is a perspective view illustrating the image forming unit according to the embodiment.

Next, the rotation mechanism 41 will be described in relation to the image forming unit 11 with reference to FIGS. 5 to 7.

First, the rotation mechanism 41 will be described with reference to FIG. 5. FIG. 5 is a perspective view illustrating the image forming unit 11. As illustrated in FIG. 5, the inkjet recording apparatus 1 further includes a main body frame 61 (frame). The main body frame 61 supports the image forming unit 11.

Specifically, the main body frame 61 rotatably supports the head base 33 around the axis AX. The main body frame 61 has a pair of frame side sections 63 and an opening 87. The frame side sections 63 face each other. The frame side sections 63 rotatably support the head base 33. The frame side sections 63 will hereafter be respectively referred to as "one frame side section 63" and an "other frame side section 63". The opening 87 is formed in the other frame side section 63 of the pair of frame side sections 63.

A portion of the rotation mechanism 41 is provided in the head base 33 and protrudes from the opening 87. Another portion of the rotation mechanism 41 is provided in a frame side section 63 so as to be adjacent to the opening 87.

Next, the rotation mechanism 41 will be described with reference to FIGS. 6 and 7. FIG. 6 is a perspective view illustrating the conveyance unit 7 and the image forming unit 11. FIG. 7 is a side view illustrating the conveyance unit 7 and the image forming unit 11. In FIG. 7, the conveyance unit 7 and the image forming unit 11 are viewed from a direction A illustrated in FIG. 6.

Figure 6:
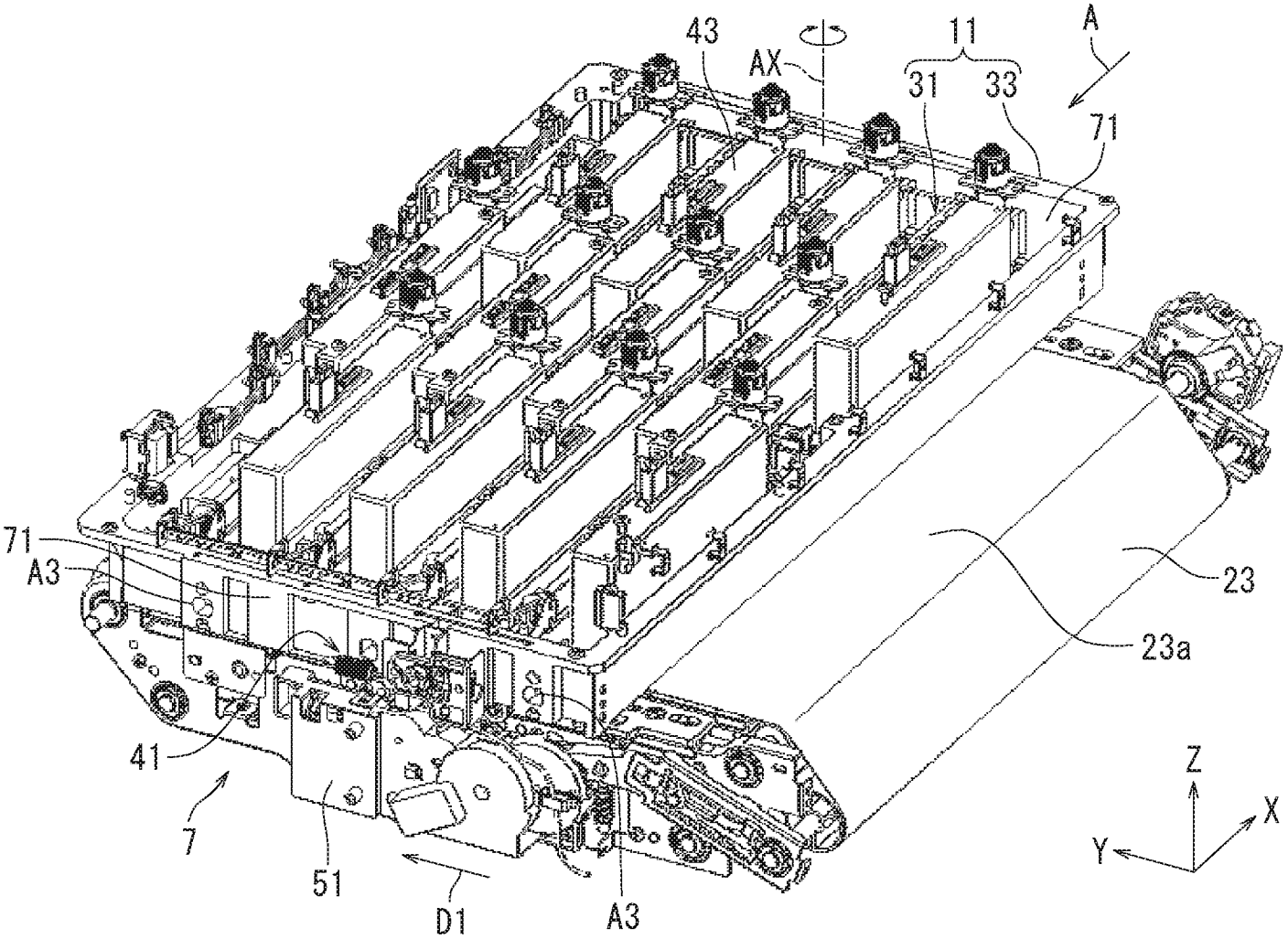
FIG. 6 is a perspective view illustrating the conveyance unit and the image forming unit according to the embodiment.
Figure 7:
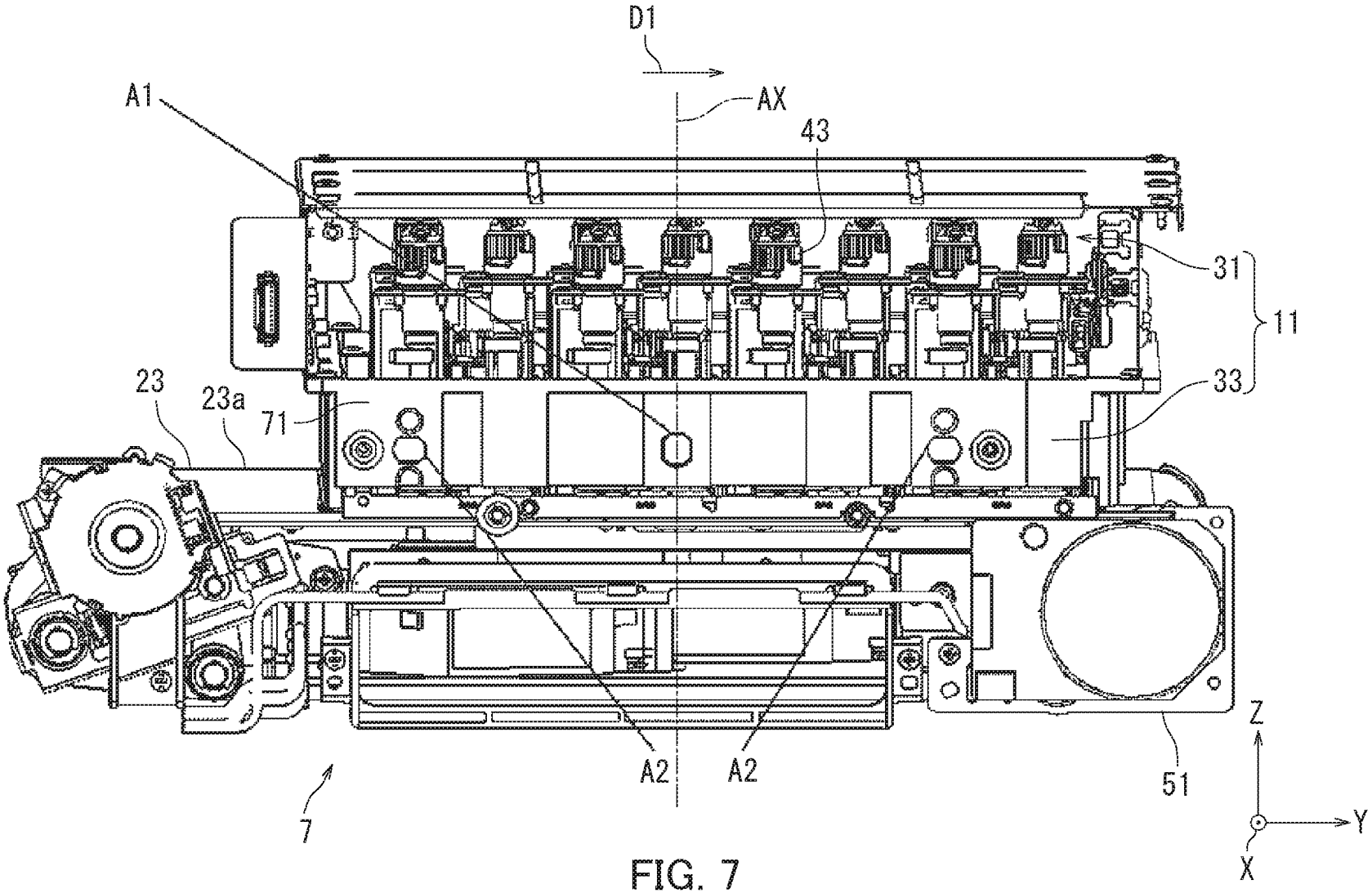
FIG. 7 is a side view illustrating the conveyance unit and the image forming unit according to the embodiment.

As illustrated in FIGS. 6 and 7, the head base 33 of the image forming unit 11 has a pair of head base side sections 71, a first hole A1, a plurality of second holes A2 (a pair of second holes A2 in the present embodiment), and a plurality of third holes A3 (a pair of third holes A3 in the present embodiment).

The head base side sections 71 face each other and extend in the first sheet conveyance direction D1.

The first hole A1 and the second holes A2 are formed in one head base side section 71 of the pair of head base side sections 71. The first hole A1 and the second holes A2 are arranged in a straight line in the first sheet conveyance direction D1.

The first hole A1 is located between the second holes A2. The first hole A1 is substantially central in a longitudinal direction of the head base side section 71. A height of the first hole A1 relative to the sheet conveyance surface 23*a* is substantially equal to a height of the second holes A2 relative to the sheet conveyance surface 23*a*.

Each second hole A2 is elongated in the first sheet conveyance direction D1. The third holes A3 are formed in the other head base side section 71 of the pair of head base side sections 71. Each third hole A3 is elongated in the first sheet conveyance direction D1. A height of the third holes A3 relative to the sheet conveyance surface 23*a* is substantially equal to the height of the second holes A2 relative to the sheet conveyance surface 23*a*.

The rotation mechanism 41 is located on a side of a different head base side section 71 than the head base side section 71 in which the first hole A1 is formed. That is, the rotation mechanism 41 is located on a side of the head base side section 71 in which the third holes A3 are formed.

Figure 8:
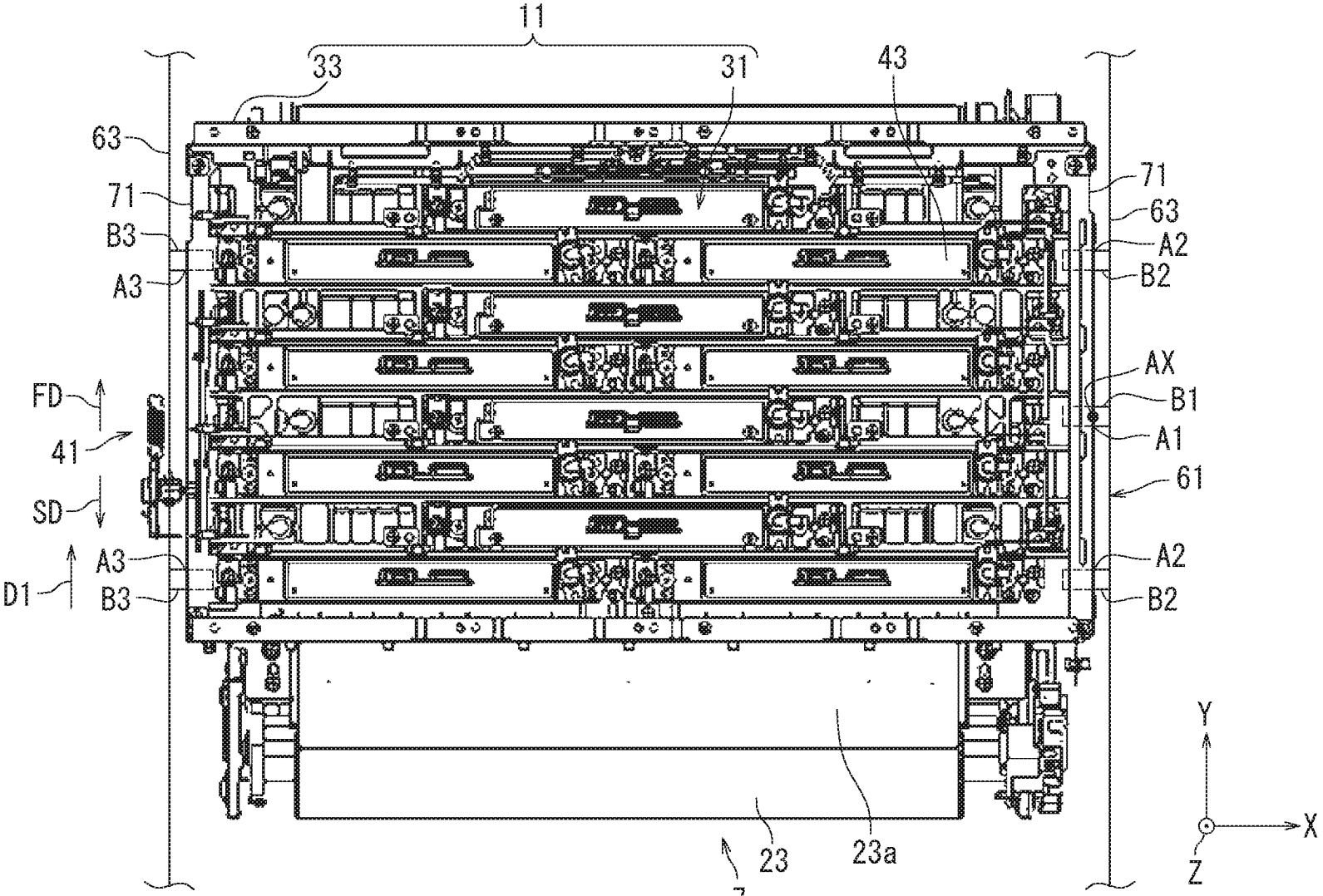
FIG. 8 is a plan view illustrating the conveyance unit and the image forming unit according to the embodiment.

Next, the first hole A1, the second holes A2, the third holes A3, and the rotation mechanism 41 will be described in relation to the main body frame 61 with reference to FIG. 8. FIG. 8 is a plan view illustrating the conveyance unit 7 and the image forming unit 11. As illustrated in FIG. 8, the main body frame 61 additionally has a first protrusion B1, a plurality of second protrusions B2 (a pair of second protrusions B2 in the present embodiment), and a plurality of third protrusions B3 (a pair of third protrusions B3 in the present embodiment).

The first protrusion B1 and the second protrusions B2 are formed on the one frame side section 63 of the pair of frame side sections 63. The frame side section 63 on which the first protrusion B1 and the second protrusions B2 are formed faces the head base side section 71 in which the first hole A1 and the second holes A2 are formed. The third protrusions B3 are formed on the other frame side section 63 of the pair of frame side sections 63. The frame side section 63 on which the third protrusions B3 are formed faces the head base side section 71 in which the third holes A3 are formed.

The first protrusion B1 is inserted into the first hole A1. A transverse section size (outer diameter, for example) of the first protrusion B1 is smaller than the size (diameter, for example) of the first hole A1. The first hole A1 restricts movement of the head base side section 71 in the first sheet conveyance direction D1. Accordingly, the first hole A1 functions as a rotational fulcrum of the head base 33. Thus, the axis AX intersects the first hole A1.

By contrast, the rotation mechanism 41 moves a different head base side section 71 than the head base side section 71 in which the first hole A1 is formed in a first direction FD or a second direction SD. As a result, the head base 33 rotates around the axis AX with the first hole A1 serving as a rotational fulcrum. That is, the conveyance unit 7 and the image forming unit 11 integrally rotate around the axis AX with the first hole A1 serving as a rotational fulcrum. Because the second holes A2 and the third holes A3 are each elongated in the first sheet conveyance direction D1, the head base 33 can smoothly rotate around the axis AX. The first direction FD extends in the first sheet conveyance direction D1. The second direction SD indicates a direction opposite to the first direction FD.

The second protrusions B2 are respectively inserted into the second holes A2. By contrast, the third protrusions B3 are respectively inserted into the third holes A3. Accordingly, the second holes A2 and the third holes A3 restrict movement of the head base 33 in a direction orthogonal to the sheet conveyance surface 23*a*. As a result, the second holes A2 and the third holes A3 position the head base 33 in the direction orthogonal to the sheet conveyance surface 23*a*. That is, the second holes A2 and the third holes A3 position the conveyance unit 7 and the image forming unit 11 in the direction orthogonal to the sheet conveyance surface 23*a*.

According to the present embodiment as described above with reference to FIG. 8, the first hole A1, the second holes A2, the third holes A3, the first protrusion B1, the second protrusions B2, and the third protrusions B3 are provided to rotate the conveyance unit 7 and the image forming unit 11. That is, the conveyance unit 7 and the image forming unit 11 can be rotated in a plane parallel to the sheet conveyance surface 23*a* with a simple configuration.

Figure 9A:
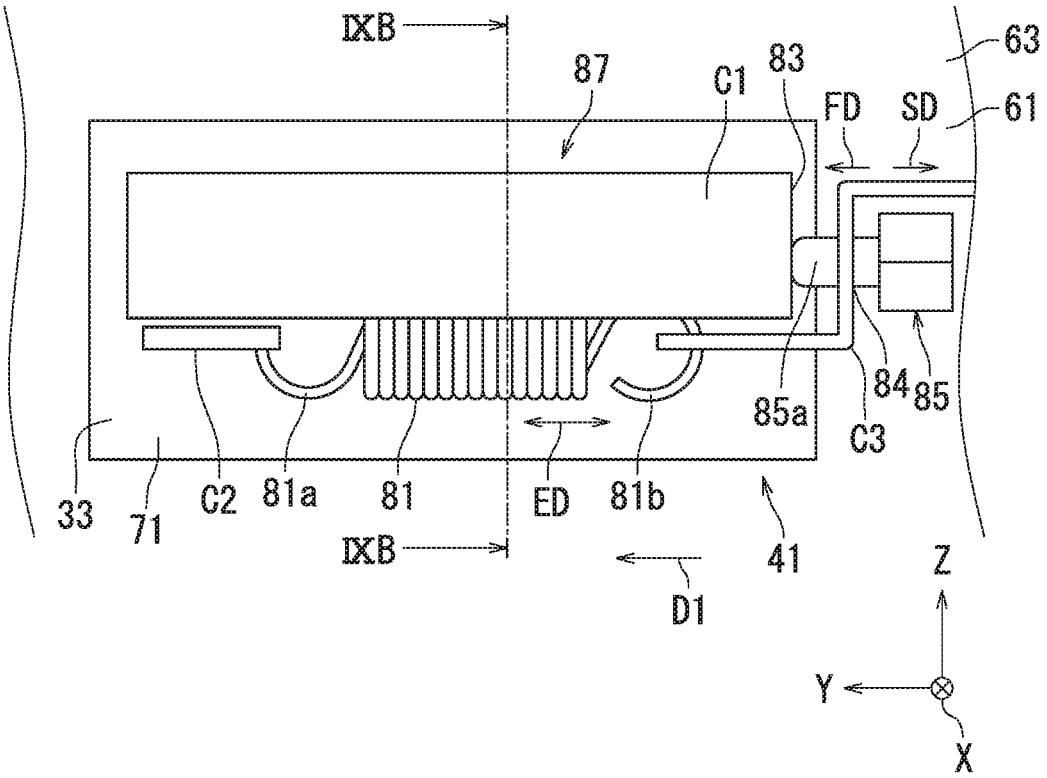
FIG. 9A is a side view illustrating a rotation mechanism according to the embodiment.
Figure 9B:
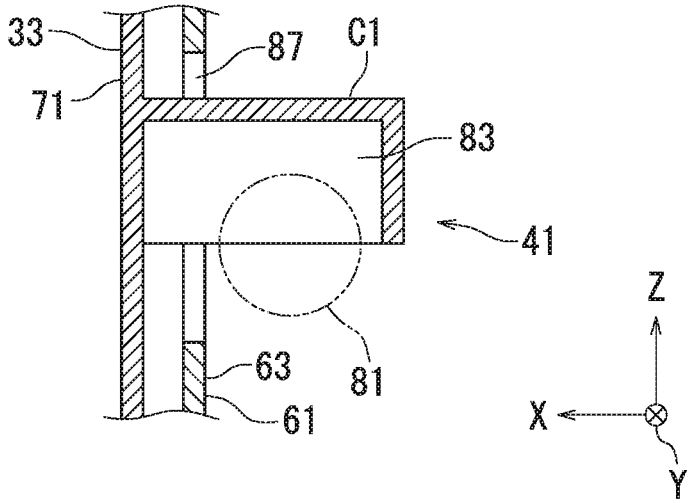
FIG. 9B is a cross-sectional view taken along a line IXB-IXB in FIG. 9A.

Next, the rotation mechanism 41 will be described with reference to FIGS. 9A and 9B. FIG. 9A is a side view illustrating the rotation mechanism 41. FIG. 9B is a cross-sectional view taken along a line IXB-IXB in FIG. 9A. As illustrated in FIGS. 9A and 9B, the rotation mechanism 41 includes a first member C1, a second member C2, a third member C3, an elastic member 81, and a contact member 85.

The first member C1 and the second member C2 are each fixed to the head base 33. Specifically, the first member C1 and the second member C2 are each fixed to a different head base side section 71 than the head base side section 71 in which the first hole A1 (FIG. 7) is formed. The first member C1 and the second member C2 protrude from the opening 87 of the frame side section 63.

A cross-section of the first member C1 is substantially L-shaped. Furthermore, the first member C1 has a contacted portion 83. The contacted portion 83 is substantially flatly plate-shaped and substantially orthogonal to the first sheet conveyance direction D1. The rotation mechanism 41 is arranged such that the contacted portion 83 is located farther upstream in the first sheet conveyance direction D1 than a center of the head base side section 71 in the longitudinal direction thereof. Note that the rotation mechanism 41 may alternatively be arranged such that the contacted portion 83 is located further downstream in the first sheet conveyance direction D1 than the center of the head base side section 71 in the longitudinal direction thereof.

The second member C2 is substantially flatly plate-shaped and substantially parallel to the first sheet conveyance direction D1. The second member C2 is adjacent to the first member C1.

The third member C3 is fixed to the main body frame 61. Specifically, the third member C3 is fixed to a different frame side section 63 than the frame side section 63 on which the first protrusion B1 (FIG. 8) is formed. The third member C3 protrudes from the frame side section 63. A screw hole 84 is formed in the third member C3. The screw hole 84 faces the contacted portion 83. The third member C3 is adjacent to the first member C1.

The elastic member 81 extends in the first sheet conveyance direction D1. The elastic member 81 is spaced from both the head base side section 71 and the frame side section 63. An end 81*a* of the elastic member 81 is attached to the second member C2. By contrast, another end 81*b* of the elastic member 81 is attached to the third member C3. The elastic member 81 is a spring (coil spring), for example.

The contact member 85 is threaded through the screw hole 84 of the third member C3 and makes contact with the first member C1. Specifically, a shaft section 85*a* of the contact member 85 is threaded through the screw hole 84 and makes contact with the contacted portion 83. The contact member 85 is movable in either the first direction FD or the second direction SD by rotating while being threaded through the screw hole 84. That is, the contact member 85 is movable in an elastic force direction ED of the elastic member 81. The elastic force direction ED extends in the first sheet conveyance direction D1. The contact member 85 is movable against the elastic force of the elastic member 81.

When the contact member 85 moves in the first direction FD, the elastic member 81 expands and the first member C1 and the second member C2 move in the first direction FD. Accordingly, the head base side section 71 to which the first member C1 and the second member C2 are fixed from the pair of head base side sections 71 moves in the first direction FD. As a result, the head base 33 rotates around the first hole A1 of the other head base side section 71 (FIG. 8).

When the contact member 85 moves in the second direction SD by contrast, the elastic member 81 contracts and the first member C1 and the second member C2 move in the second direction SD. Accordingly, the head base side section 71 to which the first member C1 and the second member C2 are fixed from the pair of head base side sections 71 moves in the second direction SD. As a result, the head base 33 rotates around the first hole A1 of the other head base side section 71.

Note that because the third member C3 is fixed to the main body frame 61, the position of the third member C3 is constant regardless of the movement of the contact member 85.

According to the present embodiment as described above with reference to FIGS. 9A and 9B, the rotation mechanism 41 includes the first member C1, the second member C2, the third member C3, the elastic member 81, and the contact member 85. That is, the head base 33 can be rotated with a simple configuration.

Also according to the present embodiment, the rotational angle of the head base 33 can be easily adjusted only by moving the contact member 85. Furthermore, it is possible to make minute adjustments to the rotational angle of the head base 33. For example, the worker can move the contact member 85 in the first direction FD or the second direction SD by threading the contact member 85 through the screw hole 84 by hand or with a tool to adjust the rotational angle of the head base 33.

Figure 10:
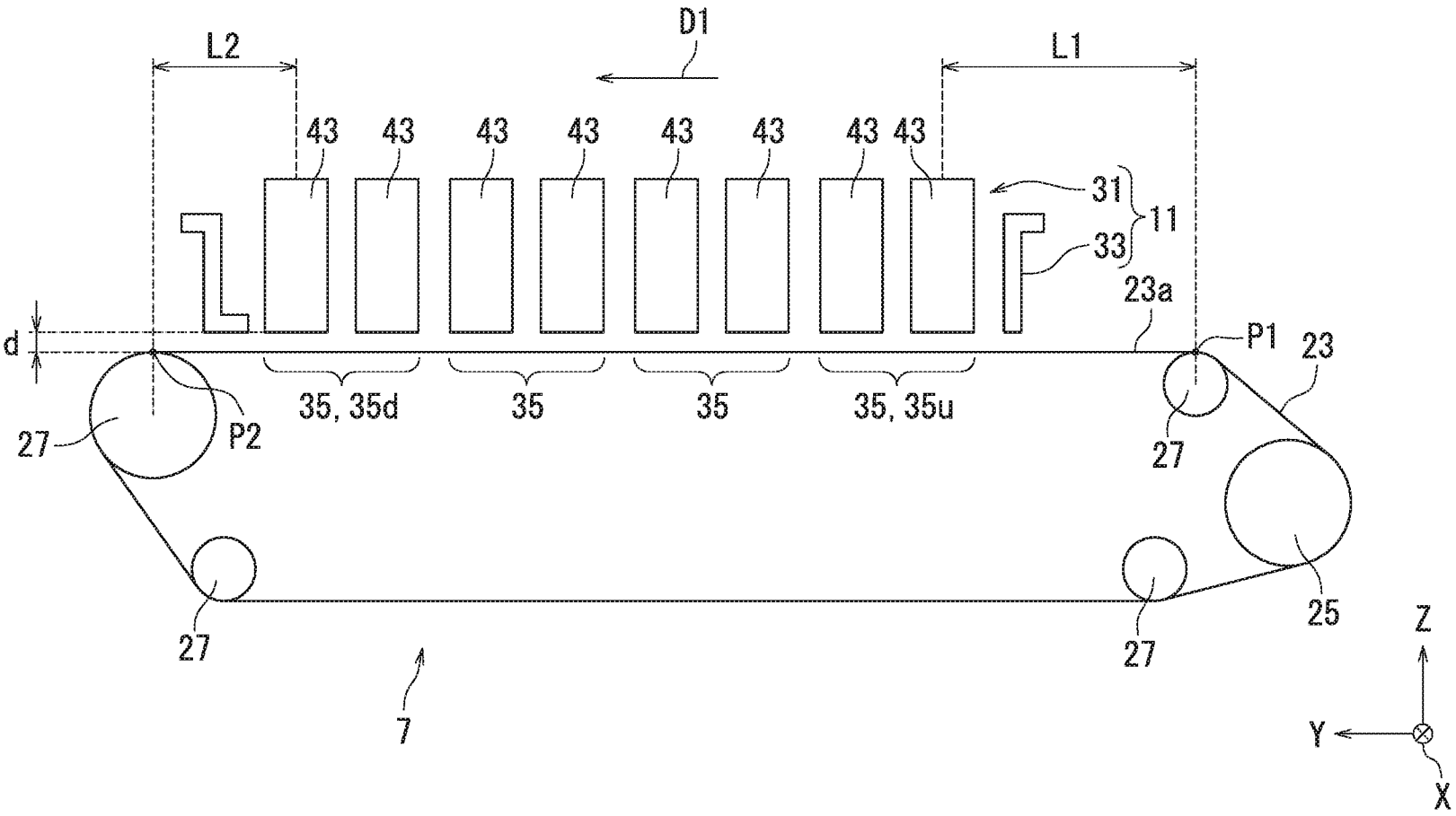
FIG. 10 is a schematic cross-sectional view illustrating the conveyance unit and the image forming unit according to the embodiment.

Next, positions of the head units 35 will be described with reference to FIGS. 3 and 10. FIG. 10 is a schematic cross-sectional view illustrating the conveyance unit 7 and the image forming unit 11. As illustrated in FIGS. 3 and 10, at least one of a first distance L1 and a second distance L2 is shorter than the maximum ink ejection range Lm of the head units 35.

The first distance L1 means a distance between the furthest upstream head unit 35*u* and a furthest upstream edge P1 of the sheet conveyance surface 23*a*. The head unit 35*u* means a head unit 35 arranged furthest upstream in the first sheet conveyance direction D1 among the head units 35. The furthest upstream edge P1 of the sheet conveyance surface 23*a* means the furthest upstream edge of the sheet conveyance surface 23*a* in the first sheet conveyance direction D1.

Specifically, the first distance L1 means a distance between a recording head 43 located furthest upstream among the recording heads 43 of the head unit 35*u* and the furthest upstream edge P1 of the sheet conveyance surface 23*a*. The first distance L1 indicates a length in the first sheet conveyance direction D1.

The second distance L2 means a distance between the furthest downstream head unit 35*d* and a furthest downstream edge P2 of the sheet conveyance surface 23*a*. The head unit 35*d* means a head unit 35 arranged furthest downstream in the first sheet conveyance direction D1 among the head units 35. The furthest downstream edge P2 of the sheet conveyance surface 23*a* means the furthest downstream edge of the sheet conveyance surface 23*a* in the first sheet conveyance direction D1.

Specifically, the second distance L2 means a distance between a recording head 43 located furthest downstream among the recording heads 43 of the head unit 35*d* and the furthest downstream edge P2 of the sheet conveyance surface 23*a*. The second distance L2 indicates a length in the first sheet conveyance direction D1.

According to the present embodiment as illustrated above in FIGS. 3 and 10, at least one of the first distance L1 and the second distance L2 is shorter than the maximum ink ejection range Lm of the head units 35. Accordingly, the length of the conveyance unit 7 in the longitudinal direction thereof can be comparatively shortened. As a result, the inkjet recording apparatus 1 can be miniaturized. Additionally, formation of a streaked image on the sheet S can be inhibited because the rotation mechanism 41 is provided. As a result, the quality of the image formed on the sheet S can be prevented from decreasing while realizing miniaturization of the inkjet recording apparatus 1. Particularly, the quality of the image can be prevented from decreasing even when the image is formed on a sheet S that is comparatively long in the sub-scanning direction when the inkjet recording apparatus 1 is miniaturized.

For example, the maximum ink ejection range Lm is substantially equal to a long side length (297 mm) of an A4-sized sheet S. Accordingly, in this example, the first distance L1 and the second distance L2 are both shorter than 297 mm. For example, the first distance L1 is 85.5 mm and the second distance L2 is 37.0 mm. Accordingly, in this example, the first distance L1 and the second distance L2 are both shorter than a short side length (210 mm) of the A4-sized sheet S. According to the present embodiment however, because the rotation mechanism 41 is provided, the sheet S is not limited to A4 size. The quality of the image can be prevented from decreasing while realizing miniaturization of the inkjet recording apparatus 1 even when the image is formed on a sheet S that is larger than A4 size. That is, the quality of the image can be prevented from decreasing while realizing miniaturization of the inkjet recording apparatus 1 even when the image is formed on a sheet S that is comparatively long in the sub-scanning direction.

According to the present embodiment, the first distance L1 and the second distance L2 may both be shorter than the short side length of the sheet S having a substantially rectangular shape. Also in this case, the quality of the image formed on the sheet S can be prevented from decreasing while realizing miniaturization of the inkjet recording apparatus 1. For example, the first distance L1 and the second distance L2 are both shorter than the short side length (210 mm) of an A4-sized sheet S when the head units 35 correspond to the long side length (297 mm) of the A4-sized sheet S.

Figure 11:
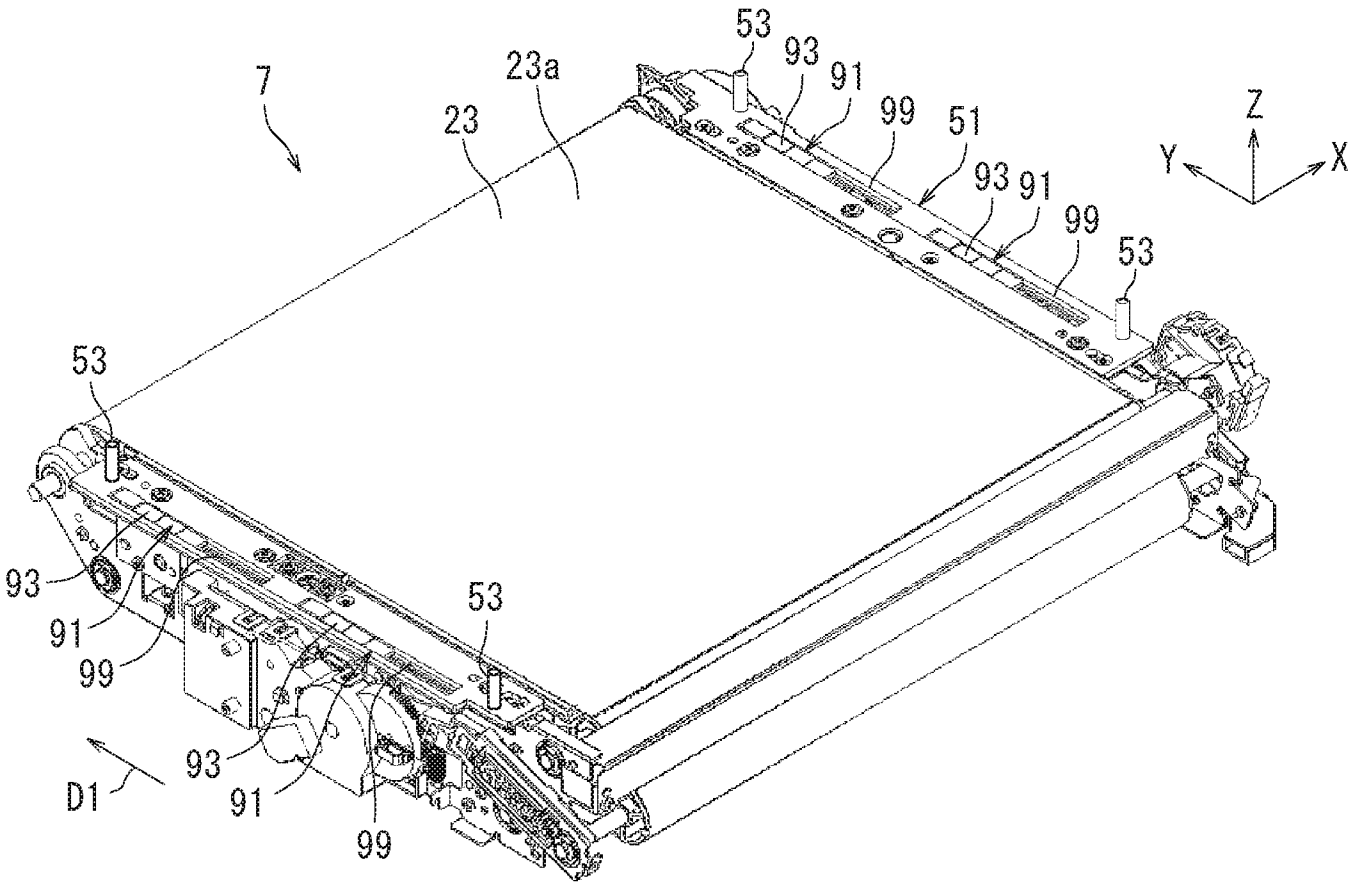
FIG. 11 is a perspective view illustrating the conveyance unit according to the embodiment.

Next, a mechanism for adjusting a distance between the inkjet head 31 and the sheet conveyance surface 23*a* will be described with reference to FIGS. 10 to 12. FIG. 11 is a perspective view illustrating the conveyance unit 7. As illustrated in FIG. 11, the conveyance unit 7 includes a plurality of distance adjustment mechanisms 91 (four distance adjustment mechanisms 91 in the present embodiment). As illustrated in FIGS. 10 and 11, the distance adjustment mechanisms 91 alter a distance d between the inkjet head 31 and the sheet conveyance surface 23*a*. Specifically, the distance adjustment mechanisms 91 alter the distance d between an ink ejection surface of the recording heads 43 and the sheet conveyance surface 23*a*. A large number of nozzles are included in the ink ejection surface.

Figure 12:
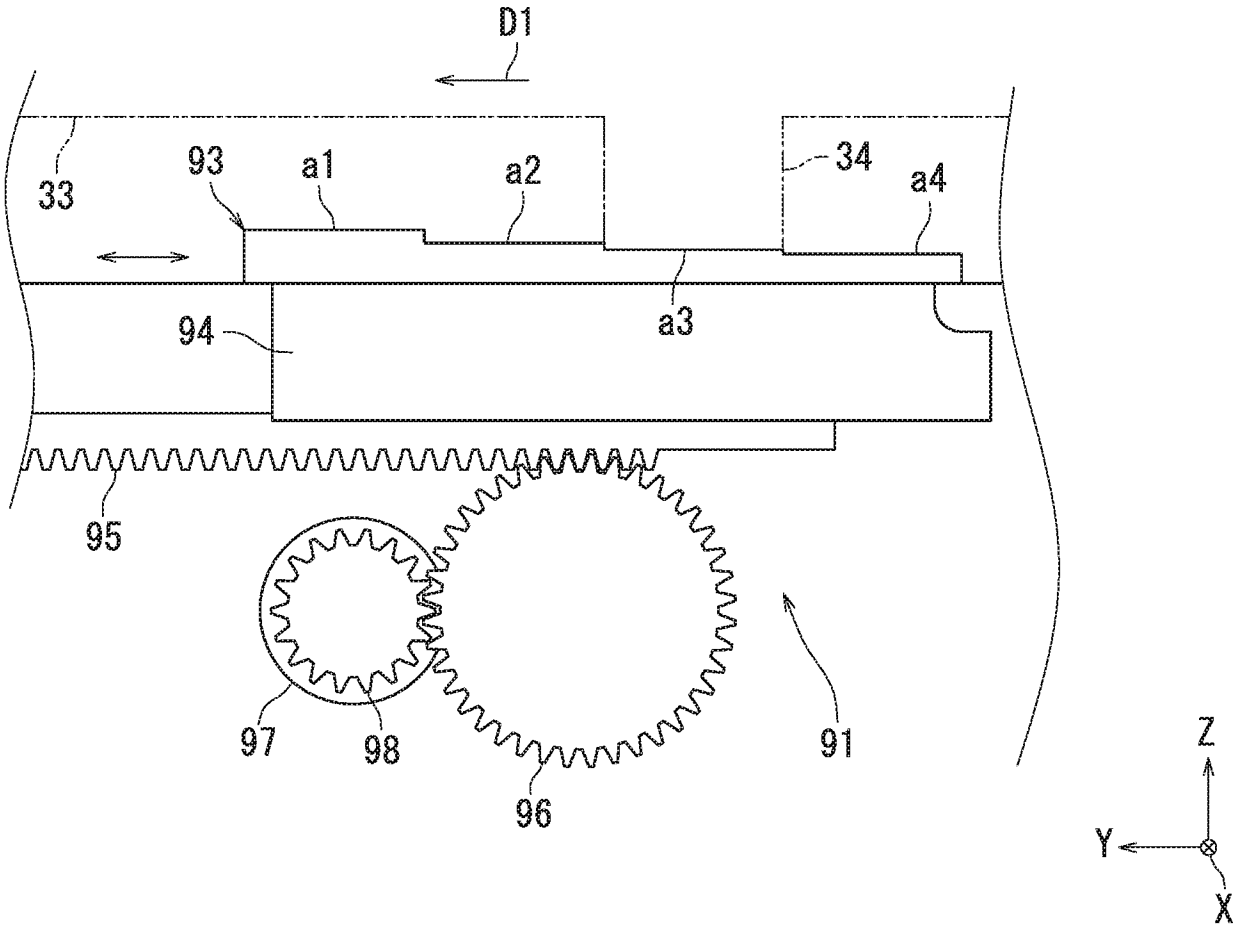
FIG. 12 is a schematic cross-sectional view illustrating a distance adjustment mechanism according to the embodiment.

FIG. 12 is a cross-sectional view illustrating a distance adjustment mechanism 91. Note that in FIG. 12, hatching for indicating the cross section is omitted and the head base 33 is illustrated with a dashed and double dotted line to simplify the drawing. As illustrated in FIGS. 11 and 12, the distance adjustment mechanism 91 includes a stair-shaped member 93, a binding member 94, a rack 95, a pinion 96, a motor 97, a gear 98, and a groove 99.

The stair-shaped member 93 and the groove 99 each extend in the first sheet conveyance direction D1. The stair-shaped member 93 is slidable within the groove 99. The stair-shaped member 93 has a flat surface a1, a flat surface a2, a flat surface a3, and a flat surface a4. There are level differences between the flat surface a1 and the flat surface a2, the flat surface a2 and the flat surface a3, and the flat surface a3 and the flat surface a4. Heights of the flat surface a1, the flat surface a2, the flat surface a3, and the flat surface a4 relative to the sheet conveyance surface 23*a* are different from each other.

The binding member 94 hinds the stair-shaped member 93 to the rack 95. The rack 95 meshes with the pinion 96. The pinion 96 meshes with the gear 98. The motor 97 rotates the gear 98. Accordingly, the pinion 96 rotates and the rack 95 moves in the first sheet conveyance direction D1 or a direction opposite to the first sheet conveyance direction D1 in accordance with the rotational direction of the pinion 96. As a result, the stair-shaped member 93 moves in the first sheet conveyance direction D1 or the direction opposite to the first sheet conveyance direction D1. The motor 97 is a stepper motor, for example.

By contrast, a lower surface of the head base 33 has a plurality of support columns 34. One support column 34 is shown in FIG. 12. The support column 34 makes contact with any of the flat surfaces a1 to a4. In FIG. 12, the support column 34 is in contact with the flat surface a3. The distance d between the inkjet head 31 and the sheet conveyance surface 23*a* is regulated by the flat surface making contact with the support column 34 from the flat surfaces a1 to a4. Accordingly, the distance d can be altered by moving the stair-shaped member 93 to choose a flat surface to make contact with the support column 34 from the flat surfaces a1 to a4. That is, the image formation position can be altered.

According to the present embodiment as described above with reference to FIGS. 10 to 12, the distance d can be altered according to a thickness of the sheet S because the distance adjustment mechanisms 91 are provided. Accordingly, a distance between the sheet S and the inkjet head 31 can be substantially constant regardless of the thickness of the sheet S. As a result, the quality of the image to be formed on the sheet S can be improved regardless of the thickness of the sheet S. For example, the stair-shaped member 93 is moved such that the support column 34 makes contact with the flat surface a1 when the thickness of the sheet S is high. Also for example, the stair-shaped member 93 is moved such that the support column 34 makes contact with the flat surface a4 when the thickness of the sheet S is low.

The embodiment of the present disclosure has been described above while referring to the drawings. However, the present disclosure is not limited to the above-mentioned embodiment, and may be performed in various manners within a scope not departing from the gist thereof. It is also possible to form various disclosures by appropriately combining multiple elements of configuration disclosed in the above-mentioned embodiment. For example, a number of elements of configuration may be removed from the entirety of elements of configuration illustrated in the embodiment. Furthermore, elements of configuration in different embodiments may be combined as appropriate. The drawings show the main respective elements of configuration schematically for ease of understanding. Properties of the elements of configuration such as thickness, length, number, and interval thereof may differ in practice from the illustrated elements of configuration to facilitate preparation of the drawings. Furthermore, the properties of the elements of configuration illustrated in the above-mentioned embodiment, such as material properties, shapes, and dimensions thereof, are merely examples and are not intended as specific limitations. The properties of the elements of configuration may be variously altered within a scope not substantially departing from the effects of the present disclosure.

What is claimed is:

1. An inkjet recording apparatus, comprising:

an inkjet head configured to eject ink on to a sheet;

a head base to which the inkjet head is fixed;

a conveyance unit facing the inkjet head and configured to convey the sheet, the conveyance unit including a conveyor belt with a sheet conveyance surface on which the sheet is placed; and a rotation mechanism configured to integrally rotate the head base and the conveyance unit around an axis perpendicular to the sheet conveyance surface of the conveyance unit while maintaining a constant relative position of the head base to the conveyance unit.

2. The inkjet recording apparatus according to claim 1, further comprising:

a frame rotatably supporting the head base, wherein the rotation mechanism includes:

a first member fixed to the head base;

a second member fixed to the head base;

a third member fixed to the frame;

a contact member in contact with the first member; and an elastic member, an end of the elastic member is attached to the second member, another end of the elastic member is attached to the third member, and the contact member is movable in an elastic force direction of the elastic member.

3. The inkjet recording apparatus according to claim 2, wherein the head base has:

a pair of head base side sections facing each other and arranged in a sheet conveyance direction;

a first hole in one head base side section of the pair of head base side sections, the first hole serving as a rotational fulcrum;

a second hole in the one head base side section; and a third hole in another head base side section of the pair of head base side sections, the second hole and the third hole each position the head base in a direction orthogonal to the sheet conveyance surface, and the frame has:

a pair of frame side sections facing each other;

a first protrusion provided on one frame side section of the pair of frame side sections and inserted into the first hole;

a second protrusion provided on the one frame side section and inserted into the second hole; and a third protrusion provided on another frame side section of the pair of frame side sections and inserted into the third hole.

4. The inkjet recording apparatus according to claim 3, wherein the rotation mechanism is located on a side of the other head base side section, different from the one head base side section having the first hole.

5. The inkjet recording apparatus according to claim 4, wherein the frame has an opening, the opening is provided in the other frame side section having the third protrusion, and the first member and the second member are each fixed to the other head base side section, different from the one head base side section having the first hole, and protrude from the opening.

6. The inkjet recording apparatus according to claim 1, wherein the inkjet head includes a plurality of head units arranged in a sheet conveyance direction, at least one of a first distance and a second distance indicating length in the sheet conveyance direction is shorter than a maximum ink ejection range of the head units, the first distance means a distance between a head unit located farthest upstream in the sheet conveyance direction of the head units and a farthest upstream edge of the sheet conveyance surface in the sheet conveyance direction, the second distance means a distance between a head unit located farthest downstream in the sheet conveyance direction of the head units and a farthest downstream edge of the sheet conveyance surface in the sheet conveyance direction, and the maximum ink ejection range indicates a maximum value of an ink ejection range of the head units in a main scanning direction.

7. The inkjet recording apparatus according to claim 1, wherein the conveyance unit includes a distance adjustment mechanism configured to alter a distance between the inkjet head and the sheet conveyance surface.

8. The inkjet recording apparatus according to claim 1, further comprising:

a registration roller located farther upstream than the conveyance unit in a first sheet conveyance direction, wherein the first sheet conveyance direction is an advancing direction of the sheet conveyance surface, the registration roller sends the sheet toward the sheet conveyance surface, and the rotation mechanism integrally rotates the head base and the conveyance unit to align the first sheet conveyance direction with a second sheet conveyance direction, the second sheet conveyance direction being a direction of conveyance of the sheet by the registration roller.

9. The inkjet recording apparatus according to claim 1, further comprising:

an ejection roller located farther downstream than the conveyance unit in a first sheet conveyance direction, wherein the first sheet conveyance direction is an advancing direction of the sheet conveyance surface, the ejection roller ejects the sheet conveyed by the conveyance unit, and the rotation mechanism integrally rotates the head base and the conveyance unit to align the first sheet conveyance direction with a third sheet conveyance direction, the third sheet conveyance direction being a direction of conveyance of the sheet by the ejection roller.

10. The inkjet recording apparatus according to claim 1, further comprising:

a registration roller located farther upstream than the conveyance unit in a first sheet conveyance direction; and an ejection roller located farther downstream than the conveyance unit in the first sheet conveyance direction, wherein the first sheet conveyance direction is an advancing direction of the sheet conveyance surface, the registration roller sends the sheet toward the sheet conveyance surface, the ejection roller ejects the sheet conveyed by the conveyance unit, the rotation mechanism integrally rotates the head base and the conveyance unit to align the first sheet conveyance direction with a second sheet conveyance direction and a third sheet conveyance direction, the second sheet conveyance direction being a direction of conveyance of the sheet by the registration roller, the third sheet conveyance direction being a direction of conveyance of the sheet by the ejection roller, and the second sheet conveyance direction and the third sheet conveyance direction are the same direction.

11. The inkjet recording apparatus according to claim 1, further comprising:

a registration roller located farther upstream than the conveyance unit in a first sheet conveyance direction; and an ejection roller located farther downstream than the conveyance unit in a first sheet conveyance direction, wherein the first sheet conveyance direction is an advancing direction of the sheet conveyance surface, the registration roller sends the sheet toward the sheet conveyance surface, the ejection roller ejects the sheet conveyed by the conveyance unit, the rotation mechanism integrally rotates the head base and the conveyance unit to bring the first sheet conveyance direction closer to a direction between a second sheet conveyance direction and a third sheet conveyance direction or align the first sheet conveyance direction with the direction between the second sheet conveyance direction and the third sheet conveyance direction, the second sheet conveyance direction is a direction of conveyance of the sheet by the registration roller, and the third sheet conveyance direction is a direction of conveyance of the sheet by the ejection roller.

* * * * *